United States Patent [19]

Hoshizaki et al.

[11] 4,358,102

[45] Nov. 9, 1982

[54] COPY PAPER FEEDING CASSETTE

[75] Inventors: Tatsuji Hoshizaki; Yutaka Seto, both of Hachioji, Japan

[73] Assignee: Konishiroku Photo Industry Co., Ltd., Tokyo, Japan

[21] Appl. No.: 154,070

[22] Filed: May 28, 1980

[30] Foreign Application Priority Data

May 31, 1979 [JP] Japan ..... 54-72367[U]
May 31, 1979 [JP] Japan ..... 54-72368[U]

[51] Int. Cl.[3] ..... B65H 1/04; B65H 3/56

[52] U.S. Cl. ..... 271/164; 271/126; 271/169; 271/170

[58] Field of Search ..... 271/169, 170, 167, 171, 271/164, 162, 126, 127, 117

[56] References Cited

U.S. PATENT DOCUMENTS 3,069,159 12/1962 Keil ..... 271/169
3,586,317 6/1971 Smitzer ..... 271/169 X
3,919,972 11/1975 Komori et al. ..... 271/169 X
4,030,725 6/1977 Fukui et al. ..... 271/171 X

FOREIGN PATENT DOCUMENTS 570829 7/1945 United Kingdom .

*Primary Examiner*—Bruce H. Stoner, Jr.
*Attorney, Agent, or Firm*—Linda G. Bierman; Jordan B. Bierman

[57] ABSTRACT

A copy sheet retaining cassette having a cutout or gate substantially centrally defined in each side wall of the cassette is further provided with a reinforcing plate pivotally mounted at a forward portion of each side wall. As the cassette is inserted into the interior of a copying machine, each reinforcing plate is moved to a substantially horizontal position at which it bridges the gate defined in the respective side wall so as to reinforce the cassette structure. A cassette holding piece carried on each reinforcing member operatively engages a cooperating machine member to stabilize the loaded cassette within the machine interior, and further carries an elastic member for engagement with the topmost ones of the copy sheets stacked in the cassette to prevent skewed feeding of the topmost sheet therefrom.

7 Claims, 14 Drawing Figures

COPY PAPER FEEDING CASSETTE

BACKGROUND OF THE INVENTION

1. Field of the Invention:

The present invention relates to a cassette for use with an electrophotographic copying machine, a facsimile apparatus, a printer, or the like, and more particularly to a copy paper retaining cassette so designed to prevent skewed feeding of paper sheets therefrom.

The invention further relates to a cassette capable of storing a greater quantity of copy sheets—as of plain paper—than a conventional cassette for the same purpose.

Although the invention is described particularly with respect to its use with a copying machine, such description is by way of example only and no intention to specifically limit the invention to such use is either intended or should be implied.

2. Description of the Prior Art:

It is well known, in conjunction with copying machines, to provide a cassette for retaining a quantity of copy papers or sheets. The cassette is loaded into the machine at a predeterminately fixed position, the copy sheets being individually fed therefrom during each copying or printing operation. Since it is generally necessary to utilize variously sized copy sheets with a single machine, a quantity of each size sheet is typically stored in its own cassette exclusively arranged for the particular sheets to be retained therein. Often, the interior dimensions of the cassettes are arranged so as to be slightly larger than the corresponding dimensions of the copy sheets to be retained, and, as a consequence, uneven or irregular stacking and slippage of various portions of the stack within the retaining area of the cassette are common problems. In addition, normal tolerances in the cutting or manufacturing operations for producing the copy sheets often lead to irregularities in the actual dimensions of individual ones or batches of the sheets, thereby facilitating irregular stacking of the sheets in a given cassette.

During each copying or printing operation, copy sheets stacked in the cassette are individually fed by rotating feeding rollers brought into pressure contact with the uppermost sheet of the stack. In order to assure that only a single sheet is fed during this operation, it is known to lightly press the front corners of the uppermost sheet by so-called separation claws. However, when the stacked sheets are irregularly or incorrectly positioned or retained within the cassette—as, for example, at an angle or skew to the forward or feeding direction—uneven pressure contact exerted by each separation claw on the respective front corner of the uppermost sheet results, causing skewed feeding of that sheet. Skewed feeding of the uppermost sheet when the same is improperly positioned in the cassette is still further facilitated because the plurality of paper feeding rollers normally provided for paper feeding do not contact the sheet with equal pressure; one side of the sheet is consequently transported faster than the other, thereby contributing to the skew. The results of skewed feeding include production of copies wherein the image on the copy sheet is itself skewed, and the frequent occurrence of internal paper jams within the copying machine.

In seeking to avoid such skewed feeding of the copy sheets, it is known to provide extruded members of an elastic material—such as sponge or the like—on the interior walls of the cassette. However, because these members are so arranged that they are located at the same height and each exerts substantially the same contact pressure on copy sheets within the cassette along the full height of the sheet stack, they have not heretofore been effective in correcting transverse dislocations of cassette-held sheets. In addition, while these prior art arrangements have been somewhat successful in preventing skewed feeding of relatively wide copy sheets, they have been generally unsuccessful in avoiding skewed feeding of more narrowly dimensioned sheets.

In seeking to generally enhance business efficiency, high speed copying machines—and particularly those which function as direct output devices for document-generating computer apparatus—are being increasingly utilized. In such high speed machines, it is desirable to minimize necessary refilling of the cassette, and cassettes capable of retaining a relatively large number of copy sheets—for example, as many as 1,000 to 2,000—are known. Large capacity cassettes of this type are sometimes provided with a gate or opening vertically extending along the central portion of the opposed side walls to facilitate loading and unloading of copy sheets. Thus, an operator can grasp a stack of copy sheets along their central side edges and, while inserting the stack into (or removing it from) the high capacity cassette, reach into its interior through the side gates or openings.

Those skilled in the art will recognize that large capacity cassettes are considerably heavier as a result of their relatively increased size, and this becomes even more significant when such casettes are fully loaded with a supply of copy sheets. Although these cassettes are typically constructed of monolithically formed plastics having sufficient strength for normal use, they are subject to twisting about the side panel gates during loading of the cassette into the main body of a copying machine. Such twisting or deformation of the cassette structure often results in transverse shifting of either all or some portion of the stack of sheets contained in the cassette, thereby affecting subsequent sheet feeding during normal operation of the machine. Skewed sheet feeding is one important problem often resulting therefrom.

SUMMARY OF THE INVENTION

It is a primary object of the present invention to provide a sheet retaining cassette constructed in accordance with the present invention to eliminate mispositioning of at least the upper ones of copy sheets stacked in the cassette.

It is a further object of the invention to provide timely correction of skewed sheet feeding utilizing position restoring power, at least insofar as such skewed feeding is caused by uneven feeding power generated by the paper feeding rollers of the copying machine.

These and other objects are attained in a cassette provided with at least an elastic member disposed along a side wall of the cassette relatively close to an end or rear wall located opposite that end of the cassette from which copy sheets are fed. Such elastic member preferably slants or is inclined gradually upward and toward the cassette interior, such that the same is brought into light pressurizing contact with the side edges of copy sheets at at least the upper portion of a sheet stack retained in the cassette.

Another object of the invention is to provide a high capacity cassette which includes a reinforcing member to assist in maintaining the structural integrity and normal configuration of the cassette, while attaining the various objectives of the invention in preventing skewed feeding of copy sheets therefrom.

In accordance with this latter object, the invention contemplates a cassette having a reinforcing plate on at least a side wall thereof, and an elastic member mounted on the reinforcing plate for maintaining proper positioning of a stack of copy sheets within the cassette. As the cassette is loaded into the main body of a copying machine, the function of the reinforcing plate is gradually provided for full cassette stabilization at its fully loaded position.

It is thereby possible to avoid distortion or mispositioning of copy sheets retained in the cassette, as well as to prevent skewed feeding of the sheets and like paper feeding difficulties occurring by reason of the aforementioned causes.

These and other features and advantages of the present invention will become more readily apparent from the following detailed description of the preferred embodiments, taken in conjunction with the accompanying drawings.

DETAILED DESCRIPTION OF THE PREFERRED EMBODIMENTS

Figure 1:
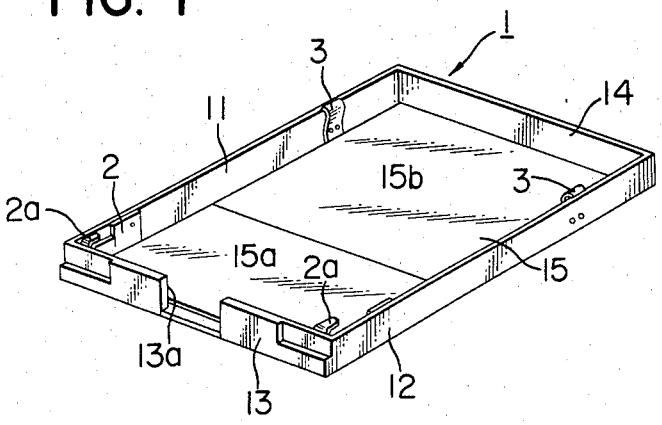
FIG. 1 is an elevated perspective view of a copy sheet feeding cassette constructed in accordance with the teachings of the present invention.

Referring now to the Drawings, FIG. 1 shows a cassette 1 constructed in the form of an open, shallow box and comprising a bottom plate (no identifying numeral), side walls 11, 12, a front wall 13, and a rear wall 14. A base plate 15 is disposed atop the bottom plate for receiving a plurality of stacked copy papers or sheets P thereon. Front portion 15*a* of base plate 15 is hinged for relative movement with respect to fixed rear portion 15*b* of the plate. Thus, when cassette 1 is fully loaded to a predetermined position in a copying machine, a movable means (not shown) of the machine enters the cassette through a gate 13*a* of front wall 13 and is received under front portion 15*a* of base plate 15. Base plate 15 is thereby pushed upward by such movable means to bring the uppermost sheet P of the stack into pressure contact with paper feeding rollers (not shown) of the copying machine.

Each front corner portion of cassette 1—i.e. the corners at that end of the cassette from which the copy sheets are fed to the copying machine—is provided with a separation claw 2*a* arranged for vertical movement. In the particular cassette illustrated in FIG. 1, each separation claw 2*a* is produced by deforming a portion of a respective plate 2 which is pin mounted to the forward portion of respective sidewalls 11, 12 for swiveled rotative movement of plate 2 about the mounting pin.

Figure 2A:
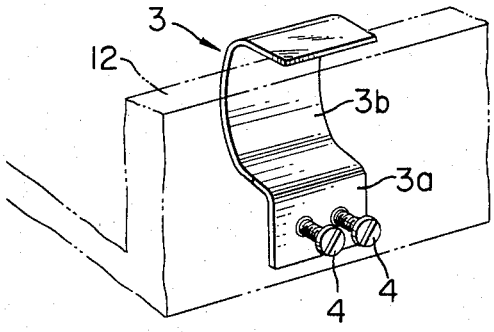
FIGS. 2A and 2B are elevated perspective views, each partly in section and partially broken away, of two forms of an elastic member in accordance with the invention.
Figure 2B:
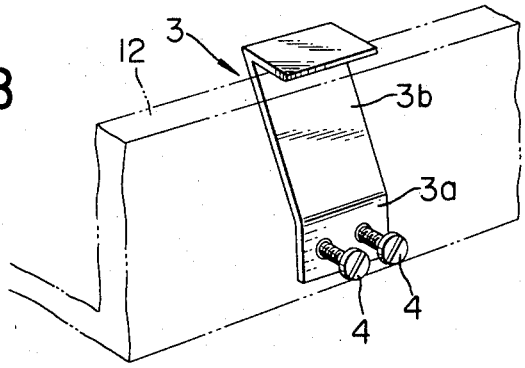

Each side wall 11, 12 carries—at a rear portion thereof—an elastic piece or member 3 fixed to the interior-oriented surface of the wall. Attachment to the walls may, for example, be attained at a lower portion 3*a* of each elastic member utilizing screws 4. Each elastic member 3 comprises a thin metallic piece, formed of phosphor bronze, etc., having a portion 3*b* which gradually extends upward and inward of the cassette side wall from its mounting 3*a*. The elastic member shown in FIG. 2A gradually curves along its portion 3*b*, while the alternate configuration of FIG. 2B has an uninterrupted ramp of substantially constant slope in lieu of the gradual curvature shown in FIG. 2A. In each instance, the very top portion of elastic member 3 curves back outwardly toward the side wall on which it is mounted and, although this topmost portion is seen in FIGS. 2A and 2B to extend back over the top of the supporting side wall, this latter detail is not necessary to proper functioning sheet position correcting function of the present invention.

Figure 3A:
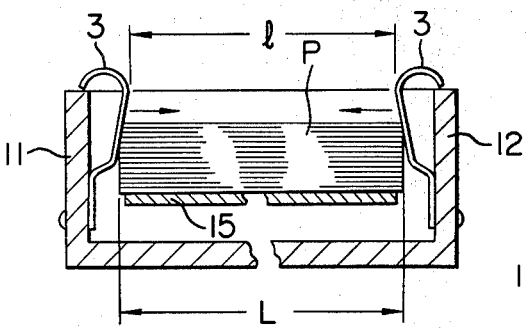
FIGS. 3A, 3B, 4A, 4B, and 5 are sectional views illustrating the functional sheet position correcting operation of the inventive cassette under various sheet storage conditions.

Referring now to FIG. 3A, elastic members 3 are so mounted and disposed on their respective side walls 11, 12, that the shortest distance or spacing l between the central portions 3*b* of the opposed members 3 is slightly narrower than the width L of copy sheets to be retained and fed from cassette 1. More particularly, the distance or spacing l is such that when a predetermined number of copy sheets—for example, 500 sheets—are stored in the cassette, the side edges of (for example) several tens of the uppermost sheets in the stack are maintained in pressure contact with the central portions 3*b* of elastic members 3. At the same time, it will be recognized that the gradual inward slanting of central portion 3*b* of each member 3 enables effective corrective sheet positioning even when only a relatively few copy sheets remain in the stack held in the cassette.

Figure 3B:
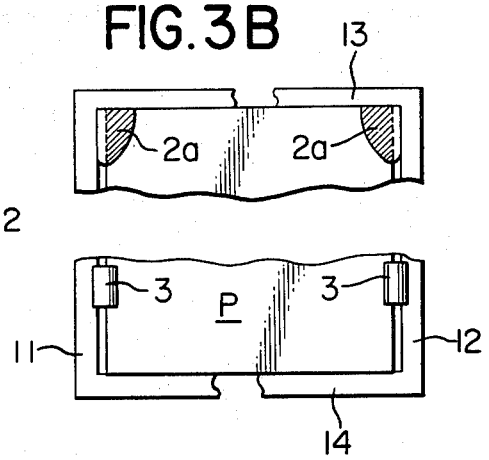
Figure 4A:
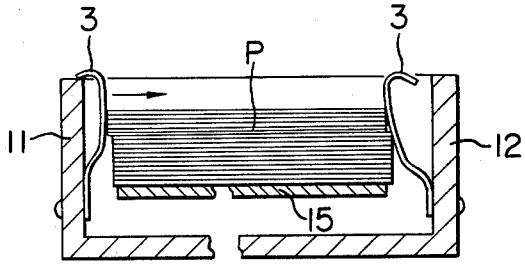
Figure 4B:
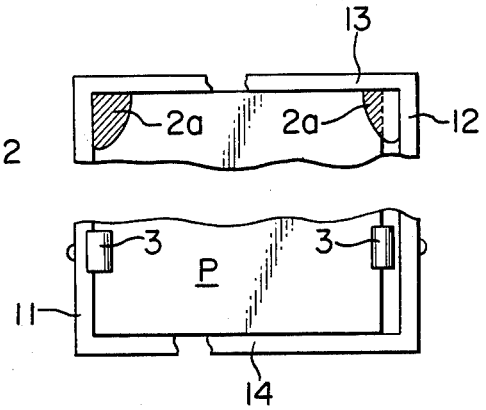

When a supply of copy sheets P are stored in cassette 1 so that the transverse location of the stack of copy sheets properly disposes them centrally between opposed sidewalls 11, 12—as seen in FIG. 3A—the force of each elastic member 3 pressing on the side edges of the topmost disposed plural sheets in the stack is substantially the same; these forces are indicated by the inwardly—directed arrows in FIG. 3A. As a consequence, each of the contact areas of separation claws 2*a* with their respective front corners of copy sheets P is likewise substantially the same (FIG. 3B) and skewed feeding of the uppermost sheet is not likely to occur. On the other hand, FIG. 4A illustrates a condition in which the topmost portion of the stack is transversely shifted or mispositioned, whereby the front corners of the uppermost sheet P are unequally contacted by separation claws 2*a* (FIG. 4B). On normal operation of conventional paper feeding rollers in the FIG. 4 condition of the sheet stack, the occurrence of skewed feeding or entanglement of multiple sheets is far more likely to occur since separation of the uppermost sheet from those immediately below it can not hardly be effectively assured by the separation claws.

The cassette 1 of the present invention, on the other hand, inherently provides a correcting force due to the unusually large deflection of the left-shown elastic member 3 in FIG. 4A. This large deflection causes an increased right-directed force to be generated by the lefthand member 3 (with respect to the righthand member 3) to effectively shift the mispositioned, topmost sheets P rightward to their proper, centrally disposed position between side walls 11, 12. Moreover, on their return to the correct, central stack position, the side edges of the topmost stacked sheets are maintained in substantially equal pressure contact between the opposed elastic members 3 so as to prevent their subsequent skewed feeding from the cassette.

Figure 5:
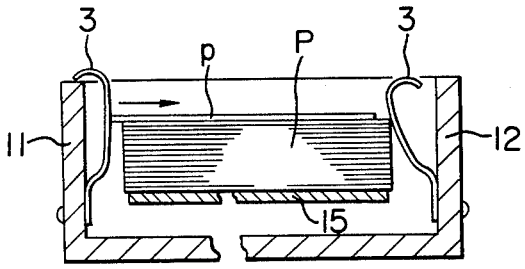

Elastic members 3 are disposed at the rear portion of each side wall 11, 12 but are inwardly spaced from rear wall 14 of cassette 1. The reason for this particular placement of the members 3 can best be appreciated by reference to certain fearures of their operation. Were these members arranged substantially at—rather than spaced inwardly from—rear cassette wall 14, as soon as feeding of a sheet from the cassette began the fed sheet would move away from and clear the position of members 3. As a consequence, elastic members 3 could perform no corrective function with respect to a sheet being fed in a skewed manner once feeding was initiated. Placement of members 3 toward the rear of the cassette—but spaced from rear wall 14—on the other hand, insures that pressure contact with a sheet being fed will continue for at least a short period after feeding has begun; as a consequence, members 3 can perform corrective realignment of a sheet which is being fed in a skewed manner at the outset—as, for example, due to uneven pressure contact of the various paper feeding rollers with the uppermost stacked sheet. This situation may be seen in FIG. 5, wherein the misaligned rear side edge of the uppermost copy sheet receives the corrective force of the lefthand elastic member 3, to enable correction of skewed feeding before the trailing edge of the sheet leaves the cassette. It is accordingly an important feature of the present invention that elastic members 3 be disposed forwardly of cassette rear wall 14, or that they alternatively be sufficiently broad or wide to extent adequately forward of the rear wall to perform such correcting function.

Figure 6:
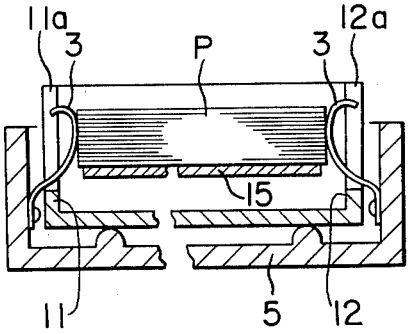
FIG. 6 is a sectional end view of a cassette similar to but slightly modified from, the inventive cassette of FIG. 1.

In the modified construction of FIG. 6, elastic members 3 are carried on a cassette holding case 5 within which cassette 1 is disposed. The curved or inwardly directed central portion **3*b* of each member 3 protrudes into the cassette interior through notches 11*a*, 12*a* defined on respective side walls 11, 12 for light pressure contact with the side edges of stacked sheets P. It should be noted that attachment of elastic members 3 to an exterior casing 5 of the cassette—rather than directly to cassette side walls 11, 12—does not diminish the effectiveness of the sheet position correction by the elastic forces of members 3** as hereinabove described.

Thus, the provision of elastic members 3 in accordance with the present invention performs two important functions, each relating to assuring non-skew feeding of copy sheets from the cassette. In the first instance, the opposed members 3 exert relatively light pressure contact against the opposite side edges of the top portion of a stack of copy sheets retained in the cassette so as to assure that at least that top portion of the stack is substantially centrally disposed between cassette side walls 11, 12. This contributes to assuring relatively straight—or unskewed—feeding of the uppermost stacked sheet during an ensuing copying operation.

Secondly, the members 3 perform a corrective function as to copy sheets which, when feeding from the cassette begins, are fed in skewed relation to the stack. Such skewed feeding typically occurs due to uneven pressure exerted by the various paper feeding rollers in contact with the uppermost sheet, or as a result of irregularities in the cassette structure or placement. The elastic extension of central portions **3*b* of members 3, and their rearward placement forwardly of cassette rear wall 14, generates correcting displacement forces of the appropriate member 3** to return the copy sheet being fed to its properly aligned orientation.

In the preceding, the elastic members 3 are recited as being formed of a thin metallic material. However, the constructional material is not intended to be so limited, and any materials having suitable elastic responsivenes-s—such as a thin member formed of sponge synthetic resin—can instead be utilized. Moreover, it should also be understood that a sufficient correcting function can be obtained by the provision of but a single elastic member 3 on one of the cassette side walls 11, 12, although the further inclusion of a second, relatively opposed member 3 on the opposite side wall renders the correcting function still more effective.

The preferred positioning of the elastic members 3 on side walls 11, 12 toward the rear of the cassette—but spaced outwardly or forwardly of rear wall 14—has been described. It is further preferred that the location of the members 3 along side walls 11, 12 be such as to position them between the longitudinal midpoint of the wall and its junction with rear wall 14, all such positioning of the members 3 taking into account sheet size, constructional materials utilized, and the depth of the cassette. Likewise, the particular manner in which elastic members 3 are mounted or otherwise supported on side walls 11, 12 may conform to any manner suitable to attain the objects of the invention. Thus, elastic members 3 might, for example, be mounted on the outer surface of side walls 11, 12 whereby the inwardly-directed portions **3*b* of members 3** extend into the cassette interior through a gate or like opening defined in each respective side wall.

Still additionally, the present invention is applicable to cassettes other than the relatively shallow one to which the preceding description has been directed. Thus, cassettes having a substantially greater depth and designed to receive a relatively large number of copy sheets—and in which a portion of each of the side walls is cut out to facilitate stacking of sheets in and removal of sheets from the cassette interior—may be provided with skewed feeding preventing members or structures formed in accordance with the present invention.

Figure 7:
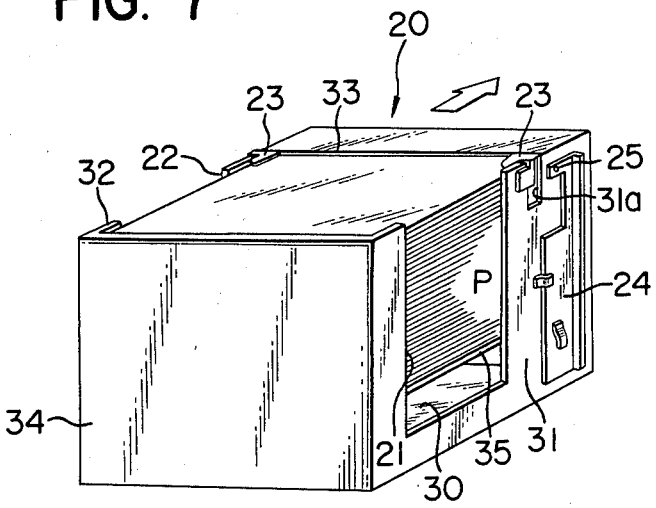
FIG. 7 is an elevated perspective view of a large capacity cassette in accordance with the present invention.

Next described is a relatively deep, large capacity cassette 20 seen in FIG. 7. Cassette 20 comprises a relatively deep box including a bottom plate 30, side walls 31, 32, front wall 33, and rear wall 34. A base plate 35 for supporting a stack of copy sheet is horizontally mounted atop bottom plate 30. A height adjustment device (not shown) arranged between bottom plate 30 and base plate 35 enables plate 35 to be correspondingly elevated as the number of copy sheets in the stack decreases so as to maintain the uppermost stacked sheet at a substantially constant level or height. Gates 21, 22 are defined at a middle portion of respective side walls 31, 32 to facilitate loading and unloading of copy sheets from the interior of cassette 20, whereby the operator's hands can grip the sheet stack along its side edges and lower or raise the stack with respect to the cassette interior through gates 21, 22. Vertically movable separation claws 23 are arranged for movement along slots 31*a* formed at the front upper corner portions of side walls 31, 32.

Figure 8:
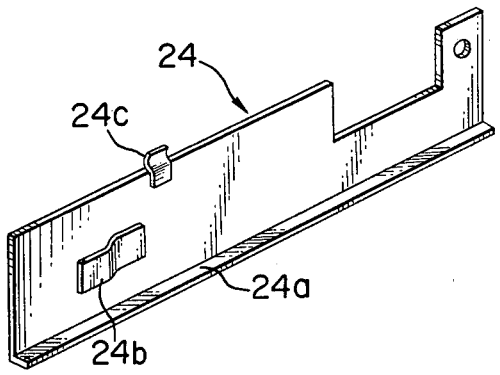
FIG. 8 is an elevated perspective view of a reinforcing plate for use with the cassette of FIG. 7.

A reinforcing member or plate 24 (best seen in FIG. 8) is mounted at the forward or feeding end of each side wall 31, 32. More particularly, each elongated reinforcing plate 24 is attached to the exterior surface of its respective side wall by a pin 25 for freely pivoting movement about the mounting pin. Thus, as shown in FIG. 7, when the cassette is not loaded into the main body of a copying machine, reinforcing plate 24—which may be formed of metal plate material—hangs down from its supporting pivot pin 25.

Again referring to FIG. 8, reinforcing plate 24 includes a bent portion 24*a* formed along a longitudinal side edge thereof, and supports a cassette holding piece 24*b* and an elastic member 24*c* mounted along one face thereof. Cassette holding piece 24*b* comprises a thin, elastic metallic member, a portion of which is disposed in spaced relation to the supporting surface of plate 24. Elastic member 24*c* includes a curved portion extending beyond the lateral edge of plate 24, and said curved portion further protrudes over the plane of plate 24 toward the cassette interior (when plate 24 is mounted on cassette 20). This curved portion of elastic member 24*c* is operatively brought into relatively light pressure contact with the side edges of copy sheets stored at the topmost portion of the stack in cassette 20 when reinforcing plate 24 is horizontally disposed at the loaded position of the cassette within the machine interior. It should, of course, be understood that although only a single reinforcing plate 24 can be seen on side wall 31 in the perspective view of FIG. 7, an identical arrangement is contemplated on the side wall 32 not visible in that drawing.

Figure 9:
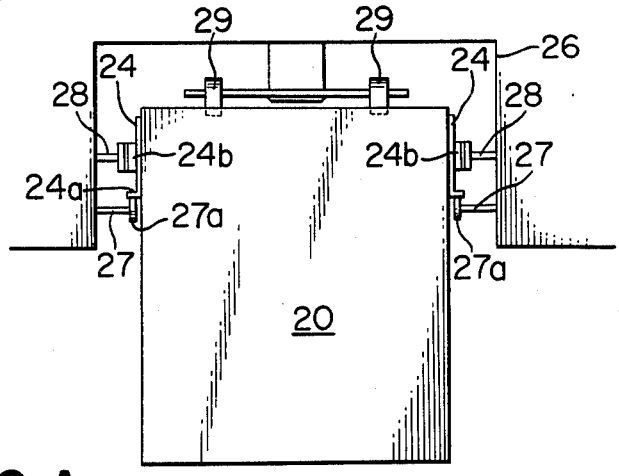
FIG. 9 is an end view of the cassette of FIG. 7 fully loaded into a copying machine.
Figure 10A:
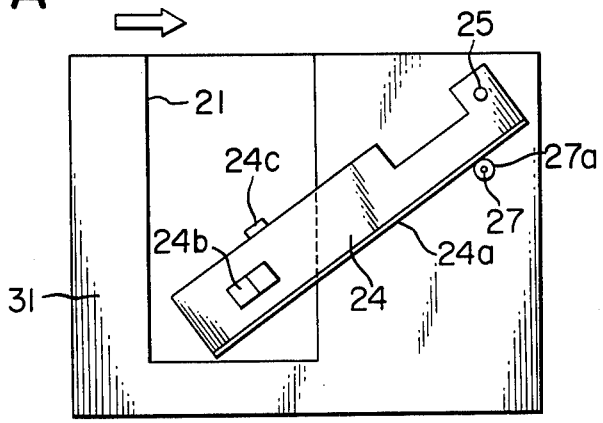
FIGS. 10A and 10B are side views of the cassette of FIG. 7 showing the position of the reinforcing plates when the cassette is first partially, and then fully, loaded, respectively, into a copying machine.
Figure 10B:
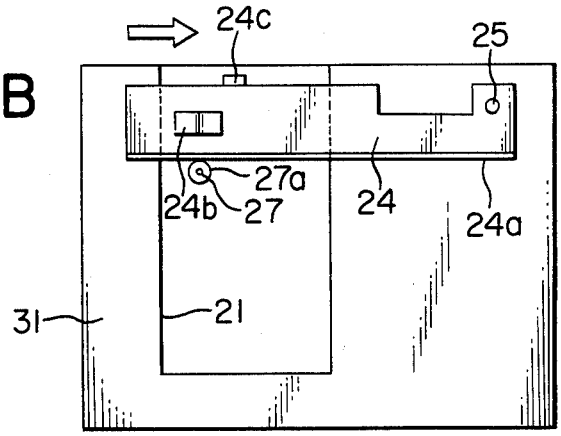

The operative interrelation of elements and structures of cassette 20 can be readily understood with reference to FIGS. 9, 10A, and 10B. As cassette 20 is loaded into the main body 26 of a copying machine, a pair of rollers 27*a*—which freewheel about supporting pins 27 extending from machine body 26—contact bent portions 24*a* of the respective reinforcing plates 24. When cassette 20 is further advanced into the machine interior, each reinforcing plate 20 swivels about its pivot pin 25 and its bent portion 24*a* is guided by and along the contacting roller 27*a*. In this manner, each reinforcing plate 24 is gradually moved from its substantially vertical rest position toward a substantially horizontal orientation which occurs on completed loading insertion of the cassette. As each reinforcing plate 24 moves toward and finally attains its substantially horizontal orientation, the free or unfulcrumed end of the plate extends over the full extent of the respective gate 21, 22 to form an exterior bridge between those portions of the respective side wall 31, 32 separated by the cutout.

When insertion of cassette 20 into the machine interior has caused it to reach its fully loaded position therein, its reinforcing plates 24 have each attained their substantially horizontal position and each holding piece 24*b* on the exterior surface of its reinforcing plate 24 contacts a pin 28 extending from machine body 26. The elastic force of holding pieces 24*b* and their contact with pins 28 cause the cassette to be inwardly pushed from opposite sides, thereby insuring stable retention of cassette 20 at its loaded position within the machine interior.

At the same time, the structural stability of cassette 20 is enhanced by the presence of horizontally-disposed reinforcing plates 24 in the loaded position of the cassette. This is so because the structural integrity or strength of cassette side walls 31, 32 is somewhat weakened by the cutouts comprising gates 21, 22, respectively. As a consequence, loading of the cassette into the machine interior may easily develop a twist or deformation of the cassette structure, and such deformation or twist is corrected by the presence of reinforcing plates 24 extendedly bridging side wall gates 21, 22. At the same time, the strength of each side wall is further enhanced by the pressure exerted by machine pins 28 and their respective engagement with elastic holding pieces 24*b*. The copy sheets stored in cassette 20 are accordingly fed into the machine in stable condition and in aligned orientation by rotation of paper feeding rollers 29 which are stationarily provided at a fixed position within machine body 26.

More particularly, in their operative or substantially horizontal positions, the elastic member 24*c* carried on each reinforcing plate 24 is disposed in relatively light pressure contact with the side edges of the topmost positioned sheets in the stack, and skewed feeding resulting from contact pressure differences between various ones of the paper feeding rollers 29 can be thereby corrected. The provision of elastic members 24*c* on reinforcing plates 24 accordingly enables correction of skewed paper feeding to be achieved without unnecessarily complicating loading or unloading of copy sheets respectively into or out of the cassette interior.

Those skilled in the art will recognize that reinforcing members 24 carrying elastic members 24*c* and cassette holding pieces 24*b* can also be utilized in connection with the cassette embodiment seen in FIG. 1, in lieu of elastic members 3 presently shown therein. Furthermore, while plural feeding rollers 29 are shown in FIG. 9, the invention may equally well be utilized with machines having but a single feeding roller. Still additionally, various relationships between certain of the elements in the cassette—such, for example, as the mounting position of the elastic member 24*c* along each reinforcing plate 24 and with respect to the side walls of the cassette—may be experimentally varied.

Numerous other changes in the form and configuration of cassettes constructed in accordance with the teachings of the invention are contemplated. Thus, a pinion mounted on each reinforcing plate 24 may cooperate with a rack disposed on the machine body 26 for effecting operative horizontal repositioning of reinforcing plates 24. It is also expected that cassette holding piece 24*b* and elastic member 24*c* may be formed of any appropriate elastic meterial—such as sponge—instead of the aforesaid metallic material.

The last described embodiment of the present invention accordingly provides the ability to correct a twist or like deformation that can readily occur in a cassette having a gate defined in at least one of the side walls thereof. Such correction is generated by automatic movement of the reinforcing plate into cross-linking position across the gate as the cassette is loaded into the machine interior. This arrangement further provides the ability to stabilize the inserted or loaded position of the cassette and to facilitate proper feeding of copy sheets therefrom by pressing and reinforcing the side walls of the cassette at its loaded position. Initially skewed paper feeding is corrected by appropriate arrangement of an elastic member on the reinforcing plate so as to place the member in slight pressure contact with the side edges of at least the topmost ones of the sheets disposed in the paper stack.

While preferred embodiments of the invention have been illustrated and described, it will be apparent to those skilled in the art that various additional changes and modifications may be made therein within the spirit and scope of the invention. It is intended that all such changes and modifications be included within the scope of the appended claims.

What is claimed is:

1. In a cassette for containing a stack of copy sheets and insertable into a reproducing machine for individual successive feeding to the machine of the uppermost sheet in the stack, a pair of opposed side walls of the cassette, each said side wall including an open gate through which copy sheets being loaded into or removed from the cassette can be grasped, a pair of reinforcing members, each carrying an elastic member thereon for pressure contact with at least the uppermost copy sheet in the stack when the cassette is fully inserted into the reproducing machine, means pivotally mounting each said reinforcing member to a respective one of said side walls proximate the front end of the cassette for pivotal movement about said means between a first position in which each said reinforcing member is disposed at a position removed from the gate of its respective side wall, and a second position in which each said reinforcing member substantially horizontally spans the gate of its respective side wall to reinforce said respective side wall by bridging said gate thereof and in which each said elastic member is thereby maintained in pressure contact through said gate with at least the uppermost copy sheet in the stack contained in the cassette, and guide means on each said reinforcing member for cooperative engagement with a portion of the reproducing machine to cause said reinforcing member to be automatically moved from said first to said second position thereof as the cassette is inserted fully into said reproducing machine from a location exterior thereto, whereby said first position of the reinforcing members in the noninserted condition of the cassette enables ready access to sheets contained in or being placed into the cassette through said gates without interference from said reinforcing members, and said automatic pivotal movement of said reinforcing members to said second position as the cassette is inserted into the reproducing machine insures that said side wall reinforcing function of said reinforcing members in spanning said gates, and said disposal of the elastic members in pressure contact with at least the uppermost copy sheet in the stack, will be attained when the cassette is fully inserted into the reproducing machine.

2. In a cassette in accordance with claim 1, cassette holding means on at least one of said reinforcing members for cooperating with the reproducing machine to facilitate stable retention of the cassette within the machine in its fully inserted condition.

3. In a cassette in accordance with claim 2, said cassette holding means comprising an elastic holding member carried on at least one of said reinforcing members and engageable with a cooperating portion of the reproducing machine when the cassette is fully inserted into the machine such that said reinforcing members are disposed in the second position thereof.

4. In a cassette in accordance with claim 1 wherein the copy sheets are fed from a forward-defined end of the cassette, said pivotal mounting means of the reinforcing members being located on said side walls proximate the forward end of the cassette.

5. In a cassette in accordance with claims 1 or 4, said reinforcing members being elongated and mounted to said side walls by said pivotal mounting means substantially at a longitudinal end of each said reinforcing member.

6. In a cassette in accordance with claim 1, said elastic members being carried on an exterior-disposed face of the respective reinforcing member and being predeterminately curved such that each said elastic member curves over an edge of the supporting reinforcing member toward the interior of the cassette through the respective gate when the reinforcing member is disposed in its second position.

7. In a cassette in accordance with claims 1 or 6 wherein the copy sheets are fed from a forward-defined end of the cassette, said cassette further including a rear wall located at a rear end of the cassette defined opposite said forward end thereof, and each said elastic member being carried on its respective reinforcing member such that said elastic member is disposed, when the reinforcing members are disposed in their second position, toward the rear end of the cassette but spaced outwardly from said rear wall thereof.

* * * * *